US006077098A

United States Patent [19]

Yu et al.

[11] Patent Number: 6,077,098

[45] Date of Patent: Jun. 20, 2000

[54] ELECTRICAL CONNECTOR FOR MEMORY MODULES

[75] Inventors: Kuo-Hsiao Yu, Taipei Hsien; Yu-Jung Lo, Tu-Chen, both of Taiwan

[73] Assignee: Hon Hai Precision Ind. Co., Ltd., Taipei Hsien, Taiwan

[21] Appl. No.: 09/176,661

[22] Filed: Oct. 21, 1998

[30] Foreign Application Priority Data

Oct. 21, 1997 [TW] Taiwan ..... 86217957

[51] Int. Cl.[7] ..... H01R 13/62

[52] U.S. Cl. ..... 439/326; 439/64

[58] Field of Search ..... 439/64, 79, 80, 439/326, 541.5

[56] References Cited

U.S. PATENT DOCUMENTS 5,176,523 1/1993 Lai ..... 439/64
5,641,295 6/1997 Koyama ..... 439/326
5,695,354 12/1997 Noda ..... 439/326
5,833,478 11/1998 Tseng et al. ..... 439/326
5,836,780 11/1998 Mizumura et al. ..... 439/326

*Primary Examiner*—Khiem Nguyen
*Assistant Examiner*—Brian S. Webb

[57] ABSTRACT

An electrical connector has a first insulative housing including an elongate bridging portion from two ends of which two guiding arms extend for guiding a memory card toward the bridging portion. The guiding arms each have a first engaging portion confronting each other. A second elongate insulative housing is detachably assembled to the first housing between the guiding arms thereof. The second housing defines a plurality of passageways for receiving contacts therein and has a second engaging portion at each end thereof for detachably engaging with the first engaging portion of the first housing. The detachable second housing allows replacement of contacts therein for adjusting to different capacities of memory modules.

19 Claims, 6 Drawing Sheets

ELECTRICAL CONNECTOR FOR MEMORY MODULES

BACKGROUND OF THE INVENTION

1. Field of the Invention

The present invention relates to an electrical connector for memory modules, and particularly to an electrical connector having detachable housings for replacing contacts easily.

2. The Prior Art

Memory modules have become popular due to the requirement of a high memory capacity of memory in a computer system to expedite the operation thereof. Higher capacity memory modules require more golden fingers which accordingly require more contacts in the connector. During a testing procedure for a mother board or while upgrading a mother board, repeated replacement of connectors for different memory modules is required. Moreover, compact size and high memory capacity requirements have been a trend in notebook computers. Persons skilled in this field usually use a stacked connector for reception of additional memory modules which may conserve space compared to the use of several connectors. However, the manufacturing procedure of stacked connectors is more complicated than a single connector resulting in a higher cost and a longer assembly time. For time conservation and cost reduction purposes, a single connector with variable types a.,.d amounts of contacts is earnestly required, i.e., a modularized connector with replaceable contacts will be beneficial to this field.

SUMMARY OF THE INVENTION

The primary purpose of the present invention is to provide a new connector which includes two housings adapted to be detachably assembled for replacement of contacts therein for adjusting to different capacities of memory modules.

In accordance with one aspect of the present invention, an electrical connector has a first insulative housing including an elongate bridging portion from two ends of which two guiding arms extend for guiding a memory card toward the bridging portion. The guiding arms each have a first engaging portion confronting each other. A second elongate insulative housing defines a plurality of passageways for receiving contacts therein and has a second engaging portion at each end thereof for detachably engaging with the first engaging portion of the bridging portion of the first housing.

In accordance with another aspect of the present invention, a stacked connector unit comprises two connectors stacked together, each connector comprising: a first insulative housing having an elongate bridging portion from two ends of which two guiding arms extend for guiding a memory card toward the bridging portion. The guiding arms each have a first engaging portion confronting each other. A second elongate insulative housing defines a plurality of passageways for receiving contacts therein and has a second engaging portion at each end thereof for detachably engaging with the first engaging portion of the bridging portion of the first housing.

These and additional objects, features and advantages of the present invention will become apparent after reading the following detailed description of the preferred embodiment of the invention taken in conjunction with the appended drawing figures.

DETAILED DESCRIPTION OF THE PREFERRED EMBODIMENTS

Figure 1A:
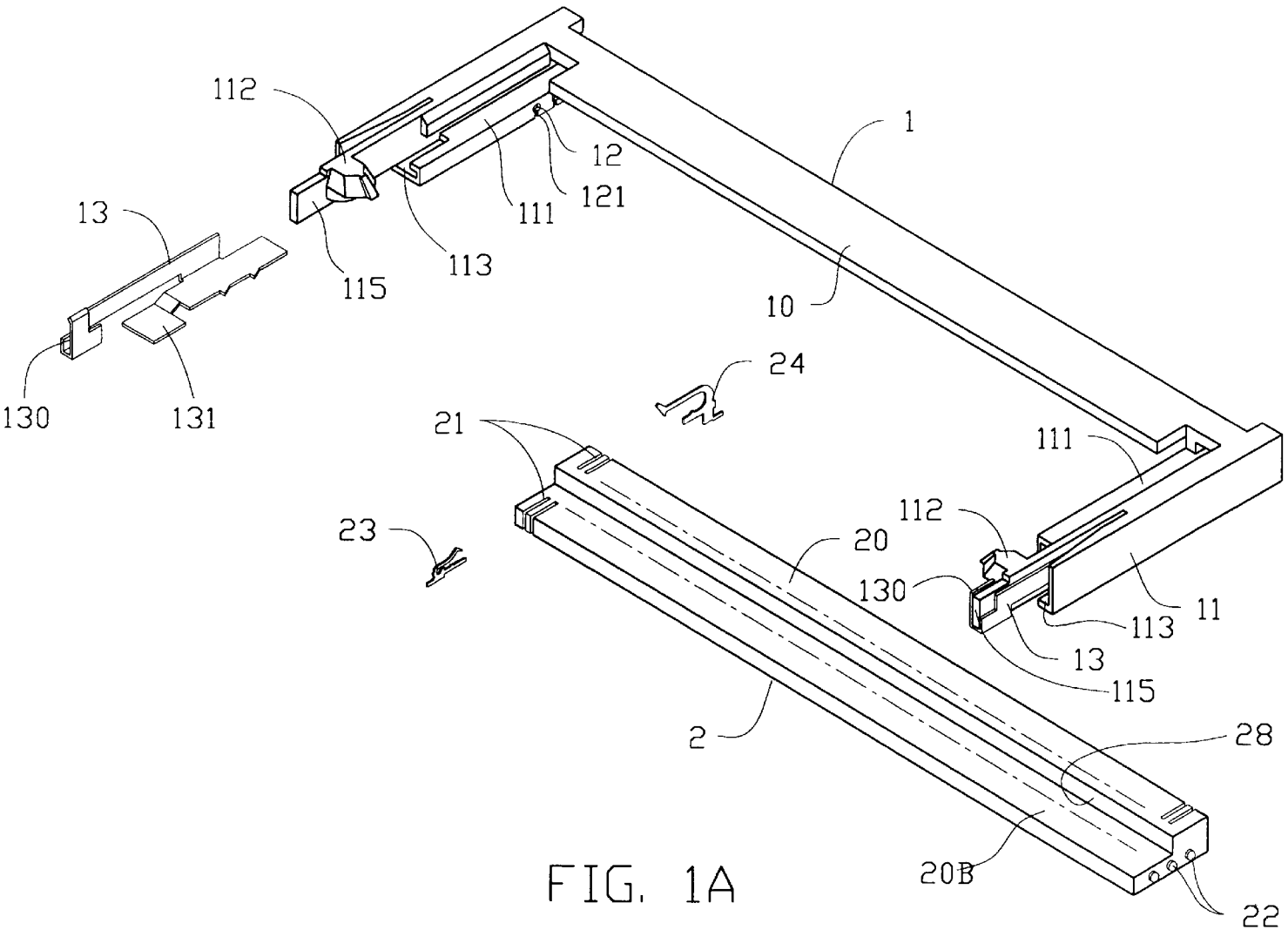
FIG. 1A is an exploded view of an electrical connector for memory modules in accordance with the present invention.
Figure 1B:
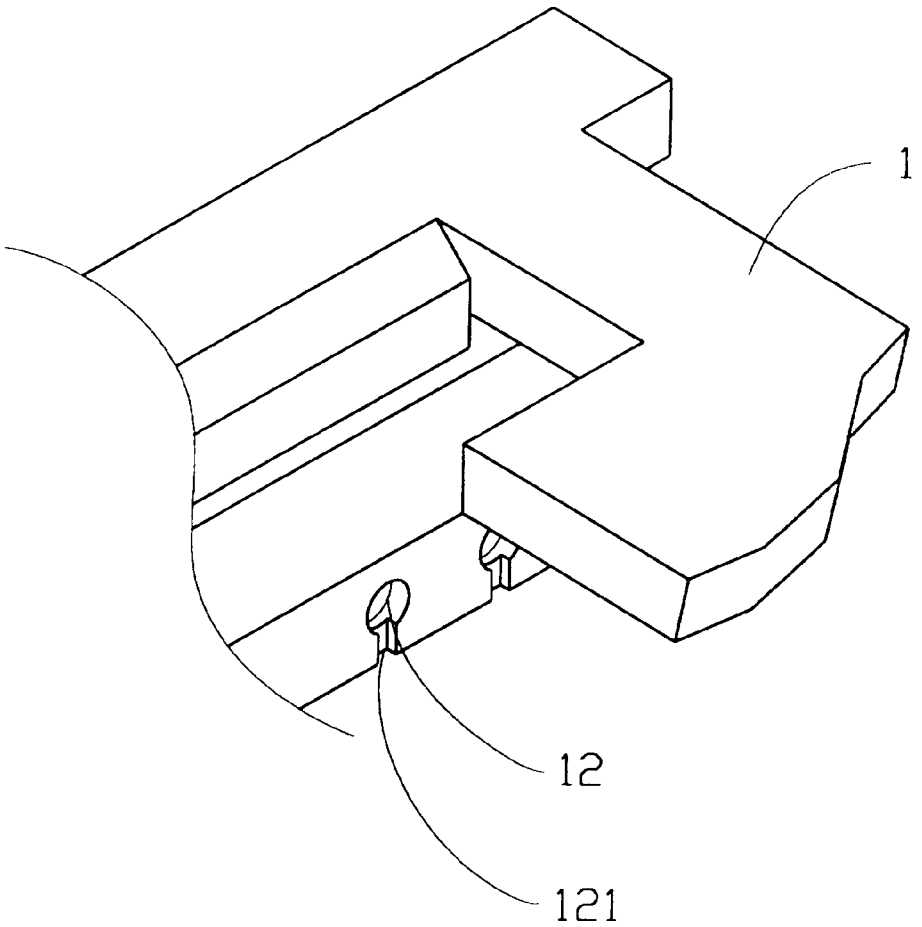
FIG. 1B is an enlarged view of a portion of FIG. 1A.
Figure 2:
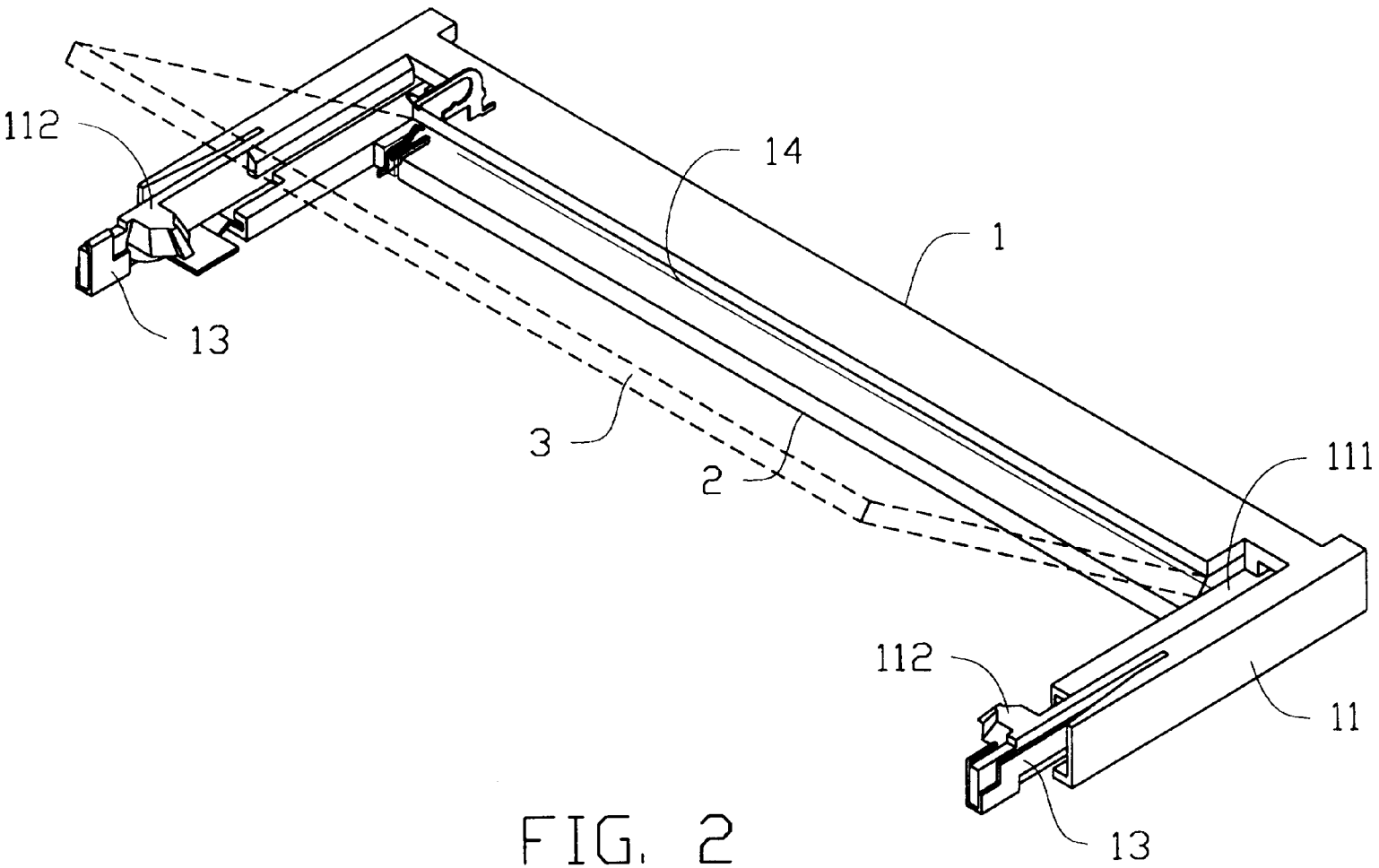
FIG. 2 is an assembled view of FIG. 1.

Referring to FIGS. 1A and 2, a first embodiment of an electrical connector in accordance with the present invention comprises a first insulative housing 1 having an elongate bridging portion 10 from two ends of which two guiding and retaining portions 11 extend for guiding a memory module card 3 toward the bridging portion 10. Each guiding and retaining portion 11 forms an elongate cavity 113 therein and an elastic bar 115 bendably extending therefrom. Each guiding and retaining portion 11 has a rail ill formed along a lengthwise direction of an upper wall portion of the cavity 113 for guiding a memory card to slide thereon. Each elastic bar 115 has an engaging protrusion 112 extending from a free end thereof wherein the engaging protrusions 112 confronts each other. A metal member 13 is formed to be matingly received in the cavity 113 with an end portion 130 thereof enclosing a free end of the elastic bar 115. The metal member 13 includes a solder pad 131 for soldering onto a printed circuit board (not shown) to reinforce the engagement between the connector and the printed circuit board and increase the grounding effect thereof. A plurality of recesses 12 are defined in an outer wall of the cavity 113 of each guiding and retaining portion 11 wherein a cutout 121 is defined in communication with each recess 12 as shown in FIG. 1B.

A second elongate insulative housing 2 defines two rows of passageways 21 for receiving first and second contacts 24, 23 therein, respectively. The second housing 2 has an upper face 20, a lower face 20B and a step portion 28 defined therebetween, with the first and second contacts 24, 23 respectively extending from the upper and lower faces 20, 20B and each first contact 24 having a lateral portion extending beyond the step portion 28 and confronting a lateral end portion of the corresponding second contact 23. A plurality of engaging protrusions 22 extend from distal ends of the second housing 2 for engaging with the recesses 12 of the first housing 1. Specifically, each protrusion 22 is firstly guided by the cutout 121 and then located in the recess 12. When the second housing 2 is assembled with the first housing 1, a mating slot 14 is defined between the bridging portion 10 of the first housing 1 and the lower face 20B of the second housing 2 for receiving the memory module card 3. The memory module card 3 is inserted into the connector from an oblique downward direction and then manually positioned horizontally to be retained in the mating slot 14, confront portions of the guiding and retaining portions 11, and engaging with the two engaging protrusions 112 of the elastic bars 115. To withdraw the card 31 the elastic bars 115 are manually bent outward and the card 3 is withdrawn in an oblique upward direction opposite to the insertion direction.

It is noted that the engagement structure between the first and second housings 1, 2 may be interchanged by forming the protrusions on the confronting walls of the guiding and retaining portions 11 of the first housing 1 and defining recesses in the distal ends of the second housing 2.

Figure 3:
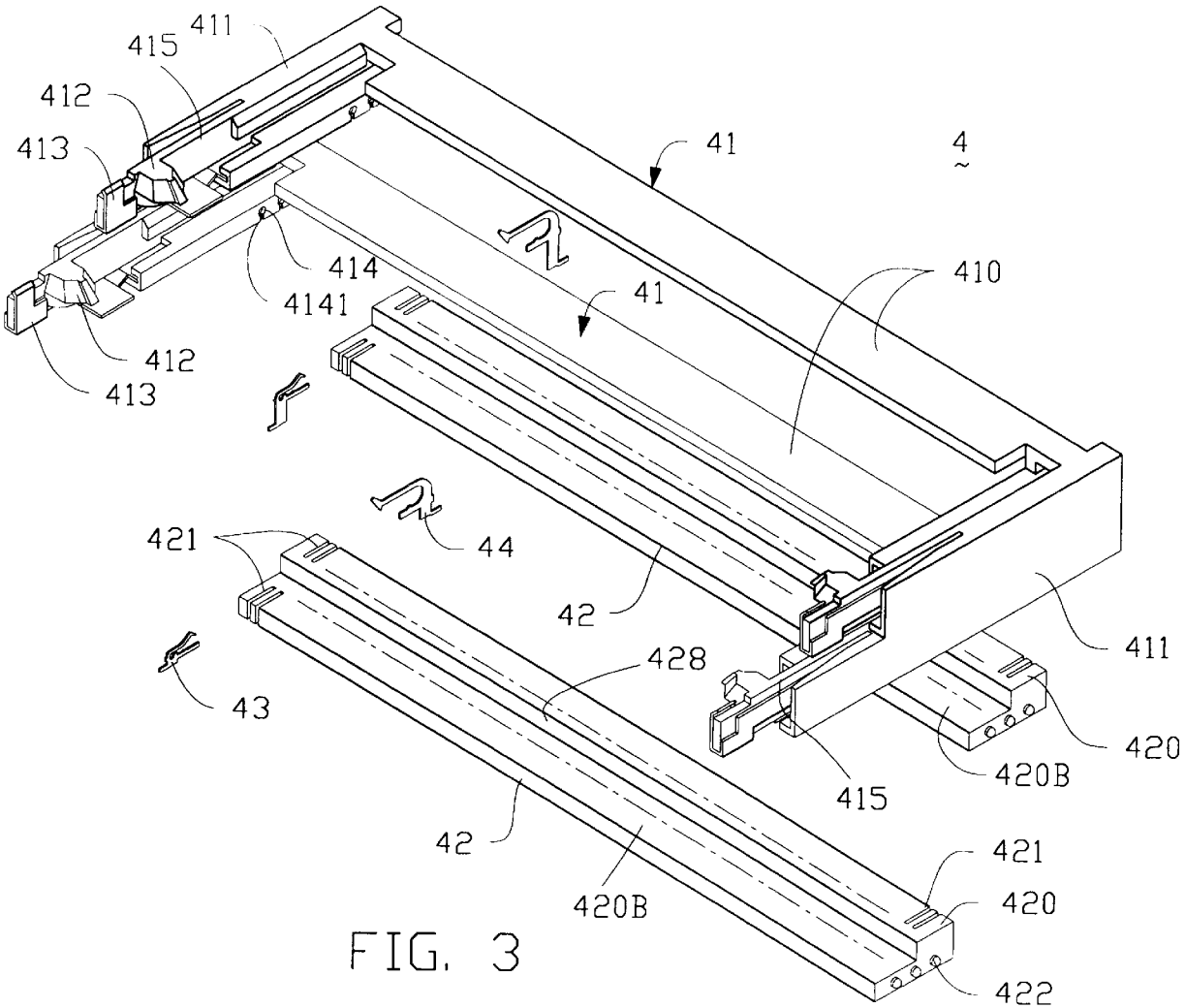
FIG. 3 is an exploded view of a stacked connector unit having the same structure as the electrical connector of FIG. 1A.
Figure 4:
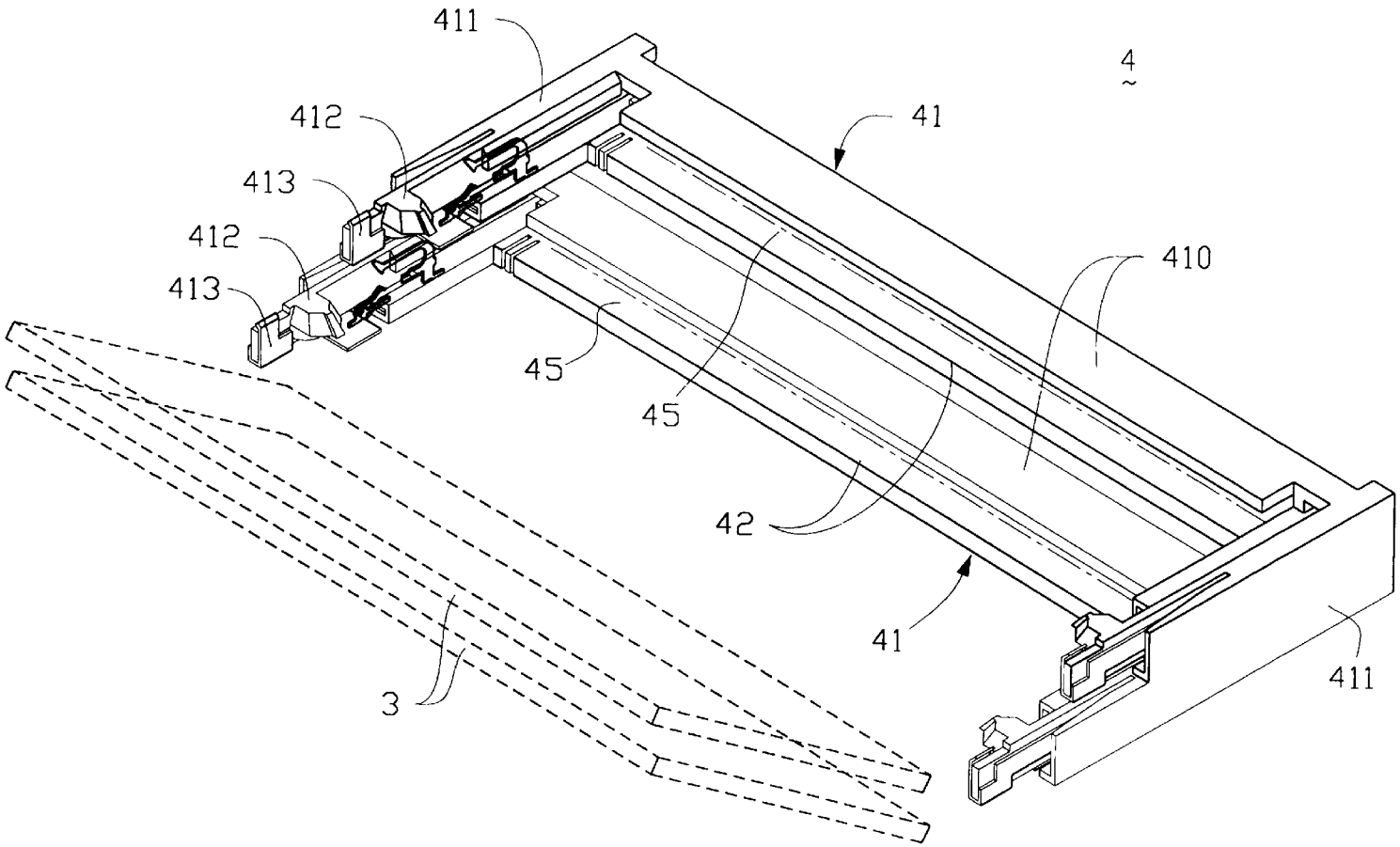
FIG. 4 is an assembled view of FIG. 3.

A second embodiment of the present invention is illustrated in FIGS. 3 and 4, wherein a stacked connector unit has two connectors stacked together, and each connector has the same structure as the first embodiment of the present invention. In this embodiment, the connector unit 4 has a pair of first housings 41 stacked together wherein only a portion of which overlap for convenient insertion of the memory module cards 3. Each first housing 41 includes a bridging portion 410 and two guiding and retaining portions 411 each of which has an elastic bar 415 extending from a reception cavity (not labeled) thereof. An engaging protrusion 412 extends from a free end of the elastic bar 415. Each guiding and retaining portion 411 also defines a plurality of recesses 414 and corresponding cutouts 4141 communicating therewith. A corresponding metal member 413 similar to that of the first embodiment is used to engage with the elastic bar 415. Two second housings 42 each have an upper face 420, a lower face 420B and a step portion 428 defined therebetween. The upper and lower faces 420, 420B each also define a row of passageways 421 for respectively receiving a plurality of first and second contacts 44, 43. Since the structure and size of the second housing 42 and contacts 44, 43 are identical to those of the first embodiment, a detailed description thereof is omitted herein. Each second housing 42 also has a plurality of engaging protrusions 422 extending from distal ends thereof for matingly engaging with the recesses 414 of the first housing 41. A mating slot 45 is defined between each pair of bridging portions 410 and the lower face 420B of the corresponding second housing 42 for receiving the corresponding memory module card 3. Since the second embodiment is merely a duplication of the first embodiment, a detailed description thereof is omitted herein.

Figure 5:
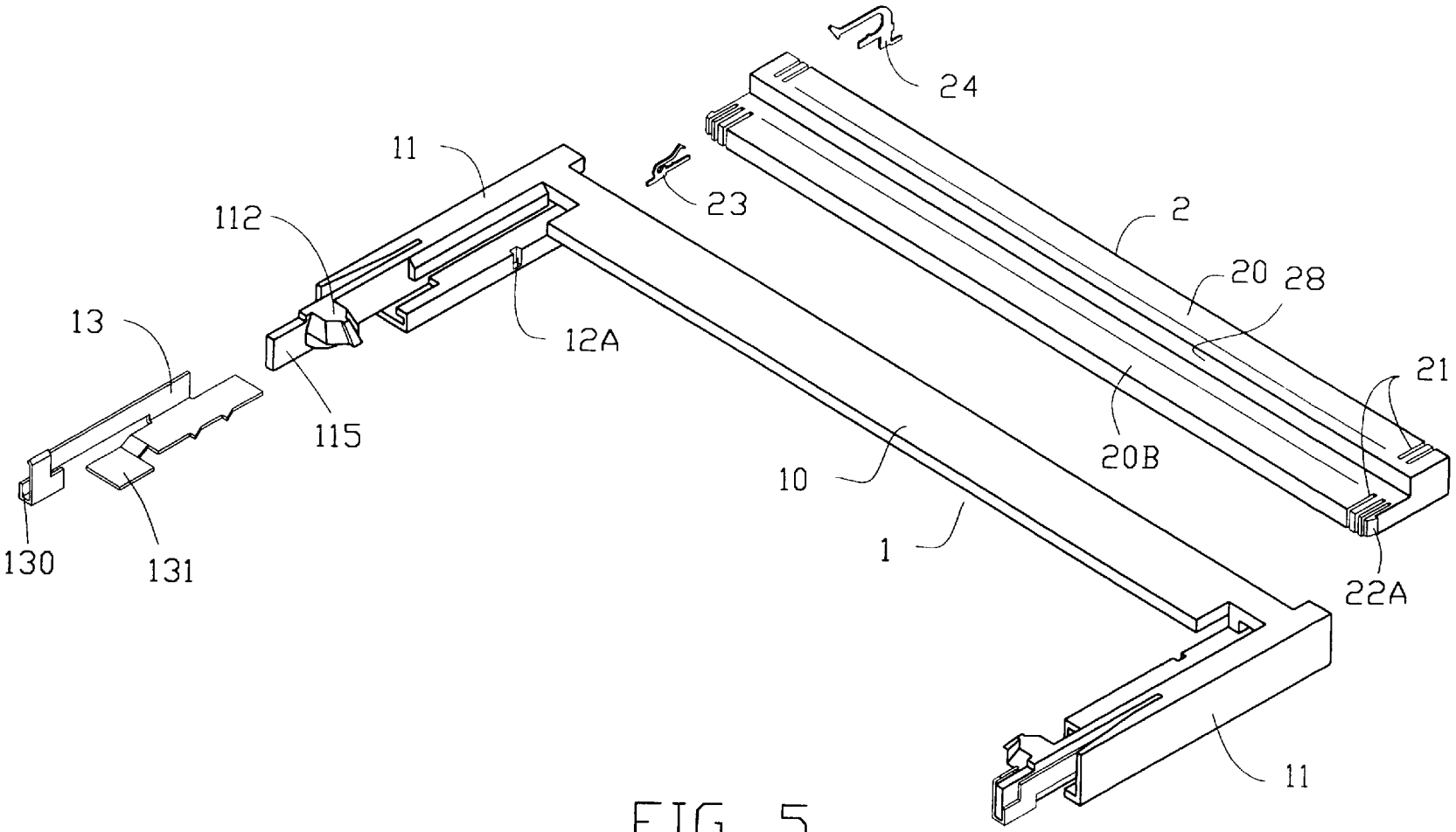
FIG. 5 is an assembled view of an electrical connector for memory modules in accordance with a second embodiment of the present invention.

A third embodiment is shown in FIG. 5, wherein the same numerals represent the same structure and function as shown in the first embodiment of FIG. 1. In the third embodiment, the engagement structures 12 and 22 between the first housing 1 and the second housing 2 of FIG. 1 are respectively replaced by a recess 12A defined in a wall portion of each guiding and retaining portion 11 and a hook 22A extending from each end of the second housing 2. The hook 22A is interferentially engaged with the recess 12A when the second housing 2 is engaged with the first housing 1.

While the present invention has been described with reference to specific embodiments, the description is illustrative of the invention and is not to be construed as limiting the invention.

Therefore, various modifications to the present invention can be made to the preferred embodiments by those skilled in the art without departing from the true spirit and scope of the invention as defined by the appended claims.

What is claimed is:

1. An electrical connector comprising:

a first insulative housing having an elongate bridging portion from two ends of which two elastic guiding arms extend for guiding a memory card toward the bridging portion, the guiding arms each having a first engaging portion confronting each other; and a second elongate insulative housing detachably assembled to the first housing between the guiding arms thereof, the second housing defining a plurality of passageways for receiving contacts therein and having a second engaging portion at each end thereof for detachably engaging with the first engaging portion of the first housing.

2. The electrical connector as claimed in claim 1, wherein the second housing has an upper face and a lower face and a step portion defined therebetween, with a plurality of first contacts and second contacts respectively extending from the upper face and lower face.

3. The electrical connector as claimed in claim 2, wherein the first contacts each have a lateral portion extending beyond the step portion and confronting a lateral portion of the corresponding second contact.

4. The electrical connector as claimed in claim 1, wherein the first engaging portion of the first housing and the second engaging portion of the second housing respectively have at least one recess means and one protrusion means adapted to be engaged with each other.

5. The electrical connector as claimed in claim 4, wherein the at least one recess means of the first housing includes a recess and a cutout communicating with the recess for guiding the protrusion means of the second housing to be received in the recess.

6. The electrical connector as claimed in claim 4, wherein the at least one protrusion means is a hook.

7. The electrical connector as claimed in claim 1, wherein the first engaging portion of the first housing and the second engaging portion of the second housing respectively have at least one protrusion means and one recess means adapted to be engaged with each other.

8. The electrical connector as claimed in claim 7, wherein the at least one protrusion means is a hook.

9. The electrical connector as claimed in claim 7, wherein the at least one recess means of the second housing includes a recess and a cutout communicating with the recess for guiding the protrusion means of the first housing to be received in the recess.

10. A stacked connector unit comprising two connectors stacked together, each connector comprising:

a first insulative housing having an elongate bridging portion from two ends of which two guiding arms extend for guiding a memory card toward the bridging portion, the guiding arms each having a first engaging portion confronting each other; and a second elongate insulative housing detachably assembled to the first housing between the guiding arms thereof, the second housing defining a plurality of passageways for receiving contacts therein and having a second engaging portion at each end thereof for detachably engaging with the first engaging portion of the guiding arm of the first housing.

11. The stacked connector unit as claimed in claim 10, wherein the second housing has an upper face and a lower face and a step portion defined therebetween, with a plurality of first contacts and second contacts respectively extending from the upper face and lower face.

12. The stacked connector unit as claimed in claim 11, wherein the first contacts each have a lateral portion extending beyond the step portion and confronting a lateral portion of the corresponding second contact.

13. The stacked connector unit as claimed in claim 10, wherein the first engaging portion of the first housing and the second engaging portion of the second housing respectively have at least one recess means and one protrusion means adapted to be engaged with each other.

14. The stacked connector unit as claimed in claim 13, wherein the at least one recess means of the first housing includes a recess and a cutout communicating with the recess for guiding the protrusion means of the second housing to be received in the recess.

15. The stacked connector unit as claimed in claim 10, wherein the first engaging portion of the first housing and the second engaging portion of the second housing respectively have at least one protrusion means and one recess means adapted to be engaged with each other.

16. The stacked connector unit as claimed in claim 15, wherein the at least one recess means of the second housing includes a recess and a cutout communicating with the recess for guiding the protrusion means of the first housing to be received in the recess.

17. An electrical connector comprising:

a first insulative housing having two guiding arms extending in a front-to-back direction and connected by an elongated bridging portion;

a second insulative housing receiving a plurality of contacts therein, the second housing being detachably assembled to the first housing between the guiding arms and under said bridging portion thereof; and means for detachably combining the first housing and the second housing together.

18. The connector as claimed in claim 17, wherein said means includes a first engaging portion on the guiding arms of the first housing and a second engaging portion on either end of the second housing.

19. The connector as claimed in claim 17, wherein a mating slot for receiving a memory module card is formed by the bridging portion of the first housing and a lower face of the second housing.

* * * * *